US005350426A

United States Patent [19]

Jenkins

[11] Patent Number: 5,350,426

[45] Date of Patent: Sep. 27, 1994

[54] CHLORINE RESISTANT CATIONIC DYEABLE CARPET YARN

[75] Inventor: William G. Jenkins, Lexington, Va.

[73] Assignee: Burlington Industries, Inc., Greensboro, N.C.

[21] Appl. No.: 104,611

[22] Filed: Aug. 11, 1993

Related U.S. Application Data

[60] Continuation of Ser. No. 892,750, Jun. 3, 1992, abandoned, which is a continuation-in-part of Ser. No. 787,220, Nov. 4, 1991, abandoned, which is a division of Ser. No. 552,178, Jul. 12, 1990, Pat. No. 5,085,667, which is a continuation-in-part of Ser. No. 519,237, May 4, 1990, abandoned.

[51] Int. Cl.[5] ..... D06P 3/00

[52] U.S. Cl. ..... 8/539; 8/676; 8/680; 8/681; 8/685; 8/924

[58] Field of Search ..... 8/539, 676, 680, 681, 8/685, 924

[56] References Cited

U.S. PATENT DOCUMENTS

| | | | |
|---|---|---|---|
| 3,904,660 | 9/1975 | Doss | 260/380 |
| 4,043,749 | 8/1977 | Huffman | 8/1 X |
| 4,496,364 | 1/1985 | Stakelbeck | 8/641 |
| 4,579,762 | 4/1986 | Ucci | 428/95 |
| 4,592,940 | 6/1986 | Blyth et al. | 428/96 |
| 5,085,667 | 2/1992 | Jenkins | 8/539 |
| 5,155,178 | 10/1992 | Windley | 8/115.6 |
| 5,199,958 | 4/1993 | Jenkins et al. | 8/539 |

FOREIGN PATENT DOCUMENTS

| | | |
|---|---|---|
| 0297748 | 1/1989 | European Pat. Off. . |
| 0353080 | 1/1990 | European Pat. Off. . |
| 0421971 | 4/1991 | European Pat. Off. . |
| 01-223908 | 9/1989 | Japan . |
| 1221574 | 9/1989 | Japan . |
| 1223908 | 9/1989 | Japan . |
| 01-260061 | 10/1989 | Japan . |
| 1-272885 | 10/1989 | Japan . |
| 1260061 | 10/1989 | Japan . |
| 1478221 | 6/1977 | United Kingdom . |

OTHER PUBLICATIONS

E. R. Trotman in "Dyeing and Chemical Technology of Textile Fibres", Sixth Edition, (Wiley–Interscience), 1984, pp. 470–471.

*Primary Examiner*—Paul Lieberman
*Assistant Examiner*—Margaret Einsmann
*Attorney, Agent, or Firm*—Nixon & Vanderhye

[57] ABSTRACT

Nylon fibers of cationic-dyeable nylon are dyed with an acid or premetalized acid dye and heatset to impart stain and bleach resistance. Stain and bleach resistant nylon carpets prepared from these fibers are also described.

8 Claims, No Drawings

CHLORINE RESISTANT CATIONIC DYEABLE CARPET YARN

CROSS-REFERENCE TO RELATED APPLICATIONS

This application is a continuation of 07/892,750, filed Jun. 3, 1992, now abandoned which is a continuation-in-part of my earlier application Ser. No. 07/787,220 filed Nov. 4, 1991, now abandoned, which is a divisional of earlier application Ser. No. 07/552,178, filed Jul. 12, 1990 now U.S. Pat. No. 5,085,667 which, in turn, is a continuation-in-part of earlier application Ser. No. 07/519,237, filed May 4, 1990, abandoned.

The invention provides stain-resistant nylon carpet having improved resistance to household bleach, spills and the like.

BACKGROUND OF THE INVENTION

My earlier U.S. Pat. 5,085,667 describes stain-resistant nylon carpet made from cationic-dyeable carpet nylon which is dyed with an acid dye or premetalized acid dye. This carpeting is highly resistant to stains compared to previously available solution dyed nylon and acid dyeable (not modified with sulfonate containing compounds) nylon carpeting, particularly acid-type stains such as beverages containing FD & C No. 40 red and similar acid-based household stains. The disclosure of this patent is hereby incorporated by reference.

Although this product has excellent stain resistant properties I have now discovered and hereby disclose a manner to improve the resistance of this carpeting to household-type chlorine-based bleach products, typically laundry bleach based upon oxidative solutions of sodium hypochlorite, calcium hypochlorite, sodium hydrogen sulfite, chlorine water and hydrogen peroxide. Household bleaches are typically based upon sodium hypochlorite in aqueous solution and have a pH of about 10. These bleach products readily oxidize the dye in non-solution dyed nylon carpets and thus present a staining or color removal problem.

Prior proposals to protect fibers and articles from attack by bleaching solutions include providing a protective coating of a guanidine compound as described in published European application 0 297 748. Other proposals include imparting stain resistance to polyamide fibers and textiles by treating them with a fluorocarbon composition and subsequently a stain blocker as described in published European application 0 353 080.

Published European application 0 421 971 describes fibers prepared from a pigmented nylon polymer that has been modified to contain aromatic sulfonated units as an integral part of its polymer chain. Pigments are added to the polymer to impart color to the fibers prior to fiber extrusion as fibers made from the modified nylon polymer cannot be dyed with acid dyes by conventional techniques, according to this disclosure. The aromatic sulfonated units are incorporated into the polymer to improve the fiber's resistance to stains, acid dye food colorants, coffee and other food products. Pigmented yarns so prepared were heatset, tufted and tested for resistance to stains. Pigmented fibers of this type are limited to the producer-determined shades and cannot be dyed with acid dyes by conventional techniques. Resistance to acid-type stains derives from the presence of aromatic sulfonated units integrated in the nylon polymer chain and not by fiber processing or carpet-constructing procedures employed.

I have discovered and hereby disclose a more convenient and reliable process to achieve fiber and fabric protection and resistance to staining caused by aqueous solutions containing peroxygen groups, hypochlorite groups or mixtures of the two in which cationic-dyeable nylon fibers are dyed with an acid dye or premetalized acid dye at a pH of from about 4.0 to less than 7 in order to fix the dye into the fibers and, thereafter, subjecting the fibers to heatsetting for a period of time and at a temperature sufficient to impart the requisite degree of stain resistance to the nylon fibers.

Heatsetting closes the crystalline structure of the nylon fibers imparting further stain resistance. Specifically, heatsetting closes the fiber structure thus preventing or substantially reducing bleach access to the dye within the fiber protecting the dye from oxidation by the bleach. An open fiber structure allows bleach to enter the fiber and oxidize the dye contained in it. Heatsetting is accomplished using times and temperatures consistent with the physical properties and characteristics of the nylon fibers employed. It is important that the heating temperature stay below the softening/melting point of the nylon as established by the fiber producer's data specific to fiber type. As an illustration, for type 66 nylon the softening/melting temperature is in the 240° C. to 255° C. range and a range of 208° C. to 212° C. for type 6 nylon. Preferably a maximum heating temperature is chosen to be about 20° C. below the softening-/melting point of the fiber used. Heating times are selected to avoid fiber yellowing leading to change of shade, loss of fastness to light and reduced performance while the time the fibers are exposed to heat must be sufficient to close the fiber's crystalline structure. Heating times are related to heating temperatures and these two variables are selected such that during heatsetting operations the fiber reaches a temperature not exceeding its melting/softening point. Preferably heating times of about one minute, plus or minus 20 seconds at the temperature ranges noted above is sufficient to achieve bleach resistance while maintaining the other desired properties of fastness to light, resistance to acid-type stains, shade consistency and the like. Shorter times and lower temperatures reduce the effectiveness of the heatsetting treatment in closing the crystalline structure of the nylon fibers.

The nylon yarns are heat set under dry or very low moisture conditions in contrast to wet heatsetting procedures such as an autoclave or a Superba unit which use pressurized steam atmospheres. Dry air assures closing the fiber's crystalline structure while heatsetting in a moist environment opens the fiber's crystalline structure. Dry circulating air is preferred. Heated drums or rolls may be used but they tend to polish or partially remove crimp from the fibers.

Heatsetting is accomplished at temperatures in the range of about 160° C. to about 220° C. for a period of time of from about 40 seconds to about 80 seconds, generally about 1 minute. Type 66 cationic dyeable nylon is preferably heatset at temperatures in the range of about 195° C. to about 220° C. and for type 6 cationic dyeable nylon temperatures in the range of about 160° C. to about 180° C. Preferably the heatsetting is conducted in dry circulating air. Products so produced are tested for acceptance by soaking them in undiluted household bleach (Clorox®) solution and then assessing the change in color, if any, after a period of four hours.

Nylon carpet fiber is generally classified as to type, depending upon its receptivity to acid dyes and basic or cationic dyes. Cationic dyeable nylons contain $SO_3H$ groups or COOH groups within the polymer structure in an amount sufficient to render the nylon fiber dyeable with a cationic dye which groups are receptive to cationic or basic dyes. Acid dyeable nylons are essentially conventional nylons, such as polyhexamethylene adipamide and polycaprolactam. Acid dyeable nylons vary as to type and are characterized as being weakly dyed with acid dyes, average dyed with acid dyes, or deeply dyed with acid dyes.

Cationic dyeable nylons generally exhibit inherent stain resistant properties, especially to acid-type stains, as compared to other nylon types used for carpet. Cationic dyeable nylons are dyeable with selected cationic dyes, but suffer from poorer lightfastness, especially in light shades, than do comparable shades dyed on acid dyeable nylon using monosulfonated or premetalized acid dyes. This has resulted in the the under-utilization of cationic-dyeable nylon as a carpet fiber. The fiber's inherently useful properties which otherwise make it attractive as a carpet fiber previously have not been fully realized.

This invention includes a procedure for dyeing cationic-dyeable nylon with acid and premetalized acid dyes resulting in nylon carpet having improved stain resistance and fastness properties.

The preferred techniques for practicing the invention include exhaust dyeing, pad/steam dyeing, continuous carpet dyeing and the like.

U.S. Pat. No. 5,085,667 provides an extensive list of acid dyes and premetalized acid dyes suitable for use in the present invention and a disclosure of this patent is hereby incorporated by reference.

U.S. Pat. No. 5,085,667 at column 10, lines 21–25 reported poor resistance of the product to bleach discoloration when compared with solution dyed nylon carpet. The procedures of the present application provide nylon carpet exhibiting resistance to bleach discoloration in a manner approaching that of solution dyed nylon carpet.

The procedures of the present invention serve to render the cationic-dyeable nylon resistant to bleaches with the heatsetting operation conducted at temperatures significantly higher than those used to exhaust dye the cationic-dyeable nylon alone. Compare exhaust dyeing temperatures as high as 212° F. (100° C.) to values nearly twice this amount using the heatsetting operation of the present invention. Moreover, the heatsetting operation is preferably conducted using dry or extremely low humidity circulating air.

The invention will be further explained with reference to the following examples which are intended to further illustrate and not limit the invention.

EXAMPLE 1

A 2 ply 1225 count "Antron" type 494 cationic-dyeable filament nylon, which had previously been dyed with premetalized acid dyes in a space dye pattern, was treated with dry heat for 1 minute at three different temperatures (195° C.; 210° C.; 220° C.). The yarn was heated in a "Sussen" which is widely used in the carpet industry as a means of setting the twist in the yarn for subsequent use in cut pile carpeting. The three heatset yarns and a control yarn of the same color which had not been heatset were each tufted into two inch bands to form a striped carpet. The carpet was then submerged in a bath of 100% Clorox®, (Clorox Company, Oakland, Calif.) a household bleach consisting of an aqueous solution containing 5.25% sodium hypochlorite, and soaked for fifteen minutes, then removed and allowed to air dry for 24 hours. The carpet was then rinsed under cold tap water, extracted, and dried in a laboratory oven at 160° F., then observed and evaluated.

The control yarn was bleached practically white whereas the heat treated yarns demonstrated considerable resistance to chlorine bleaching—generally the higher the heatsetting temperature the better the resistance to chlorine bleaching. The sample treated at 220° F. showed the most resistance to chlorine bleach.

EXAMPLE 2

Seven different 4 ply air entangled cationic dyeable (type 494-"Antron") pre-dyed yarns dyed with premetalized acid and acid dyes were heatset at 220° C. for 1 minute on the "Sussen" unit. All seven of the yarns were then tufted into loop pile carpet in 18 inch bands. The tufted carpet was then backed with a latex secondary backing. Tufted carpets using the same shade yarns which had not received the bleach resistance-impartin-g—heat treatment were used as controls. All 14 samples of carpet were spotted with 20 ml of undiluted Clorox® bleach. The bleach spots were allowed to remain on the carpet for 24 hours then rinsed and dried. A visual rating was given to the degree of color change caused by the bleach. The results are tabulated in Table I. The numerical scale used is an arbitrary 10 point scale with 1 representing total destruction of the color and 10 being no color change at all.

As can be seen, the heat treated yarns are greatly superior in the resistance to chlorine bleach, compared with the untreated controls.

TABLE I

VISUAL JUDGMENT OF RESISTANCE TO CHLORINE

| | Control (Non-heat Treated) | Heat Treated Sample |
|---|---|---|
| Color 4055 Gray Beige | 1, White, color destroyed | 8, Detectable change |
| Color 4084 Yellow Beige | 2, White, color destroyed | 8, Detectable change |
| Color 4012 Rose | 1, White, color destroyed | 8, Detectable change |
| Color 4054 Deep Brown | 2, White, color destroyed | 8, Detectable change |
| Color 4087 Light Blue | 1, White, color destroyed | 7, Detectable change |
| Color 4057 Dark Blue | 3, Most, color destroyed | 9, Slight Detectable change |
| Graphics Multiple Yarns | 1, White, color destroyed | 9–10, Non-detectable change |

EXAMPLE 3

Six of the colors from Example 2 were tested for fastness performance. In each case a control carpet which had not been heat-treated, although not the same dye lot yarn, was tested to establish a base point for comparison purposes. The fastness tests were the following American Association of Textile Chemists and Colorists (AATCC) standardized tests:

AATCC Method 166—Resistance to light fade using a Xenon Arc Fadeometer (160 hours exposure)

AATCC Method 175—Resistance to acid type stains 24 hour exposure to Acid Red 40

AATCC Method 8—Resistance to crocking or transfer of color to e white cloth (wet and city) with rubbing Shampoo—Resistance to color change when exposed 24 hours to a solution of shampoo AATCC Method 129—Resistance to ozone gas exposure, rating color change with 5 cycle exposure AATCC Method 107—Resistance to water, noting: color change, and color transfer to a multifiber cloth Ratings on the 5 point AATCC gray scale for color difference are indicated as (1) and on the 10 point AATCC stain scale as (2) in Table.

Numerical ratings from the 1991AATCC Technical Manual specific to the type of test are as follows:

1. Degree of Alteration in Lightfastness, Hue and Saturation of Color.

Class
- 5 —negligible or no change
- 4 —slightly changed
- 3 —noticeably changed
- 2 —considerably changed
- 1 —much changed 2. Degree of Crocking or Staining of Effect Fibers Class
- 5 —negligible or no staining
- 4 —slightly stained
- 3 —noticeably stained
- 2 —considerably stained
- 1 —heavily stained 3. Degree of Staining, AATCC Test Method 175

10 =NO STAIN
1 =Very heavily stained

The fastness results are tabulated in Table II and show no adverse effect on any of the properties tested. Those knowledgeable in heatsetting effects however would expect an improvement in the AATCC 175 test (Resistance to Acid Stain); however the beginning yarns in these cases were already rated a 10 or no staining after 24 hours exposure to Acid Red 40.

What is claimed is:

1. A process of dyeing and imparting improved household bleach stain resistance to cationic-dyeable nylon fibers comprising the steps of:
   (a) dyeing said fibers with an acid dye or a premetalized acid dye at a pH of from about 4.0 to 6.5 and fixing the dye into the fibers, and thereafter
   (b) heatsetting the fibers by heating the dyed fibers under dry conditions to a temperature of about 160° C. to about 220° C. and for a time sufficient to close the fiber crystalline structure and impart resistance to hypochlorite or peroxy-group containing aqueous solutions.

2. A process of preparing a stain-resistant, bleach-resistant, lightfast nylon carpet comprising dyeing cationic-dyeable nylon fibers with an acid dye or a premetalized acid dye at a pH of from about 4.0 to 6.5 and heating the dye-laden fibers to fix the dye into the fibers, and thereafter heatsetting the dyed fibers under dry conditions at a temperature of about 160° C. to about 220° C. for a time sufficient to close the fiber's crystalline structure and impart bleach resistance to the nylon carpet.

3. The process of claim 1 or 2, in which the cationic-dyeable nylon fibers are fibers of nylon 66 and are heated at a temperature of about 195° C. to about 220° C. for a period of time of from about 40 seconds to about 80 seconds.

4. The process of claim 1 or 2, in which the cationic-dyeable nylon fibers are fibers of nylon 6 and are heated at a temperature of about 160° C. to about 180° C. for a period of time from about 40 seconds to about 80 seconds.

5. The process of claim 1 or 2, in which the nylon fibers are dyed at a pH of from about 4.0 to 6.0.

6. The process of claim 1 or 2, in which, subsequent to dye fixation, a fluorocarbon soil repellant is applied to the fibers.

7. The process of claim 1 or 2, in which a premetalized acid dye is used.

8. The process of claim 1 or 2, in which the nylon fibers are overprinted with acid dyes or premetalized dyes to give multiple color effects on the same strand of yarn.

* * * * *

TABLE II

| | | AATCC 160 Hrs. 16E (1) Light | AATCC 175 (2) Stain | AATCC 8 (1) Crock Wet | Dry | Shampoo (1) | AATCC 129 5 Cycle (1) Ozone | AATCC 107 (1) Color Change | Stain Effect (1) Cloth |
|---|---|---|---|---|---|---|---|---|---|
| Color 4055 Grey Beige | control | 4/5 | 10 | 5 | 5 | 5 | 4/5 | 5 | 3 |
| | heat treated | 4/5 | 10 | 5 | 5 | 5 | 4/5 | 5 | 3 |
| Color 4084 Yellow Beige | control | 4/5 | 10 | 5 | 5 | 5 | 4/5 | 5 | 3 |
| | heat treated | 4/5 | 10 | 5 | 5 | 5 | 4/5 | 5 | 3 |
| Color 4012 Rose | control | 4/5 | 10 | 5 | 5 | 5 | 4/5 | 5 | 3 |
| | heat treated | 4/5 | 10 | 5 | 5 | 5 | 4/5 | 5 | 3 |
| Color 4054 Deep Brown | control | 4 | 10 | 5 | 5 | 5 | 4/5 | 5 | 3–2 |
| | heat treated | 4 | 10 | 5 | 5 | 5 | 4/5 | 4/5 | 3 |
| Color 4087 Lt. Blue | control | 4 | 10 | 5 | 5 | 5 | 4/5 | 5 | 4 |
| | heat treated | 4 | 10 | 5 | 5 | 5 | 4/5 | 5 | 3/4 |
| Color 4057 Dark Blue | control | 4/5 | 10 | 5 | 5 | 5 | 4/5 | 4/5 | 3 |
| | heat treated | 4/5 | 10 | 5 | 5 | 5 | 4/5 | 4 | 2 |